United States Patent [19]

Gornstein et al.

[11] Patent Number: 4,962,718

[45] Date of Patent: Oct. 16, 1990

[54] HYDROFOIL PROPULSION SYSTEM

[75] Inventors: Robert J. Gornstein, Vashon; Richard J. Rust, Westport; William Husa, Auburn; Randolph J. Rust, Westort, all of Wash.

[73] Assignee: Westfoil International, Wesport, Wash.

[21] Appl. No.: 320,686

[22] Filed: Mar. 7, 1989

Related U.S. Application Data

[63] Continuation-in-part of Ser. No. 186,625, Apr. 27, 1988, abandoned.

[51] Int. Cl.[5] ..... B63B 1/24

[52] U.S. Cl. ..... 114/274; 440/1; 440/37

[58] Field of Search ..... 114/274, 281; 440/57, 440/37, 3, 53, 4, 50; 244/62; 180/117-119

[56] References Cited

U.S. PATENT DOCUMENTS

| | | | |
|---|---|---|---|
| 1,073,567 | 9/1913 | Burney | 114/274 |
| 1,160,021 | 11/1915 | Watson | 244/105 |
| 1,190,944 | 7/1916 | Orlando | 440/37 |
| 1,747,334 | 2/1930 | Sundstedt | 244/105 |
| 2,112,965 | 4/1938 | Koster | 244/62 |
| 3,213,818 | 10/1965 | Barkley | 114/66.5 |
| 3,601,980 | 8/1971 | Faber | 60/11 |
| 3,910,215 | 10/1975 | Soderman | 114/279 |
| 3,968,762 | 7/1976 | Meyer, Jr. | 114/66.5 |
| 4,311,472 | 1/1982 | Hiersig et al. | 440/75 |
| 4,322,208 | 3/1982 | Kelpin | 440/31 |
| 4,565,532 | 1/1986 | Connor | 440/57 |

FOREIGN PATENT DOCUMENTS

| | | | |
|---|---|---|---|
| 738646 | 12/1932 | France | 114/274 |
| 46851 | 10/1936 | France | 114/274 |
| 152395 | 5/1962 | U.S.S.R. | 114/274 |

*Primary Examiner*—Joseph F. Peters, Jr.
*Assistant Examiner*—Ed Swinehart
*Attorney, Agent, or Firm*—Christensen, O'Connor, Johnson & Kindness

[57] ABSTRACT

A hydrofoil propulsion system (10) utilizing dual water propellers (16) in combination with dual shrouded air propellers (18). The air propellers (18) and the water propellers (16) are powered by diesel engines (22) mounted in pairs inside the hull (24) of the hydrofoil craft (b 14). Each water propeller (16) is affixed to an outdrive 35 through a pivotal propeller shaft (28) that permits the propeller shaft (28) and the water propeller (16) to move horizontally and vertically with respect to the hull (24). An air propeller (18) and a water propeller (16) are each coupled to a single pair of engines (22) so that as the craft (14) transitions from the hullborne mode to the foilborne mode, the thrust load is automatically transferred from the water propeller (16) to the air propeller (18).

9 Claims, 2 Drawing Sheets

HYDROFOIL PROPULSION SYSTEM

This application is a continuation-in-part application based on prior copending application Ser. No. 07/186,625, filed on Apr. 27, 1988, now abandoned.

TECHNICAL FIELD

The present invention relates to propulsion systems for hydrofoil watercraft and, more particularly, to a combined water propeller and air propeller propulsion system operatively coupled to a common power source for automatically transferring the thrust load between the water propeller and the air propeller as the hydrofoil watercraft transitions between waterborne and foilborne modes of operation.

BACKGROUND OF THE INVENTION

A hydrofoil watercraft typically consists of a displacement hull boat to which is attached "wings" or hydrofoils that generate lift as they travel through the water, much in the same way that the airfoil design of aircraft wings provide lift in the air. When the hydrofoil craft is operating at low speeds in what is termed the "hullborne mode," the hull functions as a conventional displacement hull to support the craft on the water. As the craft attains higher speeds, the lift provided by the flow of water over the hydrofoil is sufficient to lift the hull entirely clear of the water. At this point, the craft is operating in the "foilborne mode." Once out of the water, the hull no longer suffers resistance from friction with the water, or from waves in rough water, so that higher speeds and a more stable ride can be attained.

Propulsion systems for commercial hydrofoil craft usually consist of marine diesel engines which drive propellers at the end of long inclined shafts that project from under the hull. The use of water propellers in the foilborne mode limits the top speed of the craft because water propellers become inefficient at the higher speeds at which hydrofoil craft are capable of operating and require greater horsepower. One method for overcoming this drawback is to use water jets. Although this method has provided some increased speed over water propellers, the intake openings and additional equipment of the water jets increases weight and creates drag that will limit the speed of the craft.

One proposal for overcoming these disadvantages is to use a propulsion system that does not rely upon the water, such as air propellers or jet engines. The drawback to this proposal is that maneuverability becomes very difficult when the hydrofoil craft is operating in the hullborne mode. In addition, the air propellers are not as effective as water propellers in accelerating the craft to the transition speed. Hence, there is a need for a propulsion system for hydrofoil craft that provides acceleration and maneuverability when the craft is in the hullborne mode and also provides efficient maximum thrust for high speed operation in the foilborne mode.

SUMMARY OF THE INVENTION

A combined air and water propulsion system for a hydrofoil craft is provided, wherein the craft is capable of operating in a waterborne mode and a foilborne mode. The propulsion system comprises at least one air propeller positioned to propel the hydrofoil craft horizontally across the water and at least one water propeller positioned to propel the hydrofoil craft horizontally across the water. Preferably, at least one motor means is operably coupled to the air propeller and the water propeller for driving both propellers.

In accordance with another aspect of the present invention, a first air propeller and a second air propeller are positioned to propel the hydrofoil craft horizontally across the water, and a first water propeller and a second water propeller are positioned to propel the hydrofoil craft horizontally across the water. A first drive motor is operatively coupled to the first air propeller and the first water propeller, and a second drive motor is operatively coupled to the second air propeller and the second water propeller such that during transition of the hydrofoil craft from a waterborne mode to a foilborne mode the thrust load will be automatically transferred from the first and second water propellers to the first and second air propellers. Preferably, the air propellers are shrouded.

In accordance with yet another aspect of the present invention, the first and second water propellers are pivotally mounted to the hull of the craft for vertical and horizontal movement.

In accordance with still yet another aspect of the present invention, the first drive motor and the second drive motor each consist of a pair of drive motors operably connected to a mixing gear box through clutches that permit selective engagement and disengagement of each motor in the pair.

BRIEF DESCRIPTION OF THE DRAWINGS

The foregoing and other features and advantages of the present invention will become more readily appreciated as the same becomes better understood by reference to the following detailed description when taken in conjunction with the accompanying drawings wherein.

DETAILED DESCRIPTION

Figure 1:
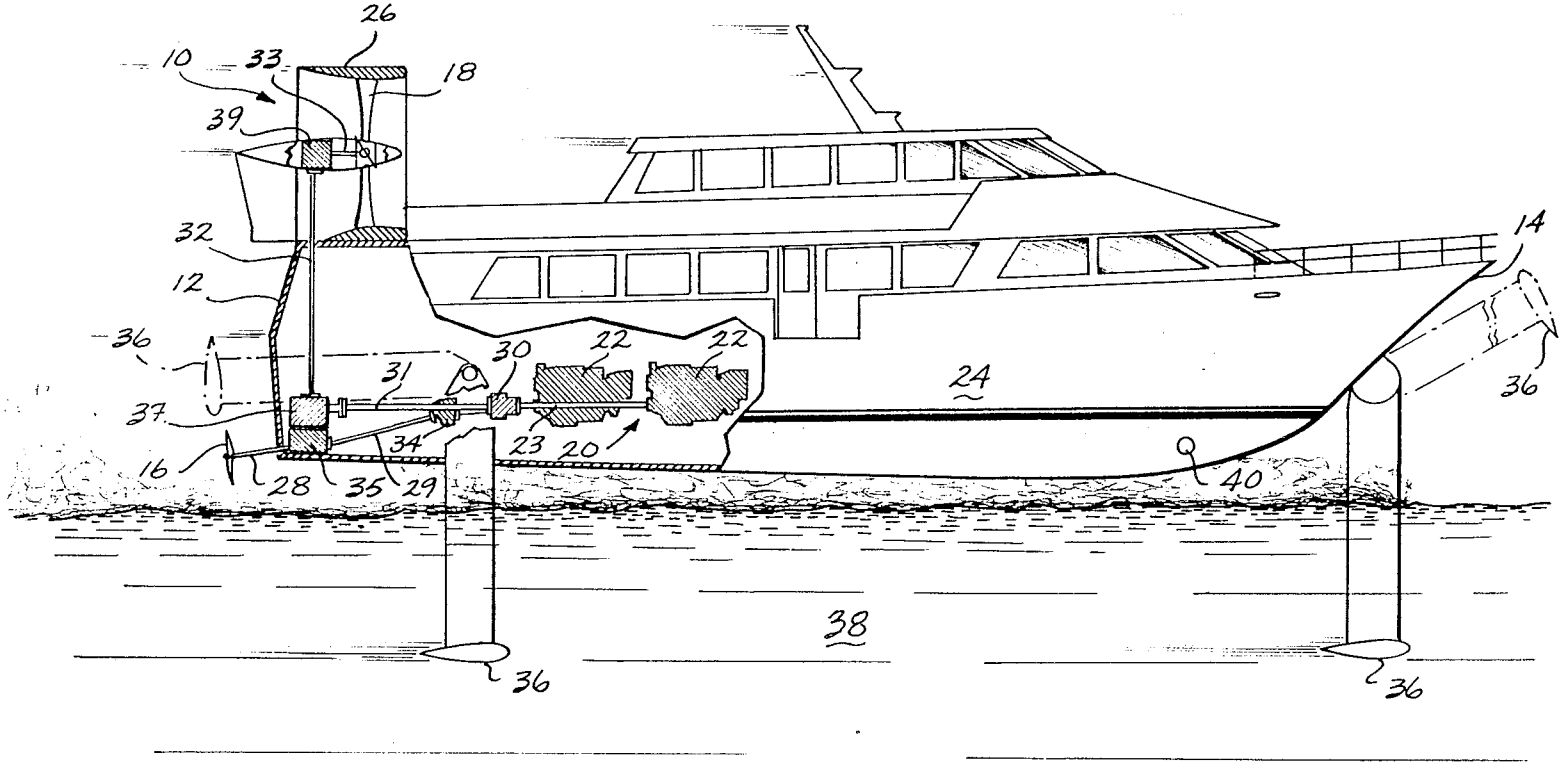
FIG. 1 is a side view in partial cross section of a hydrofoil craft utilizing the propulsion system formed in accordance with the present invention.
Figure 2:
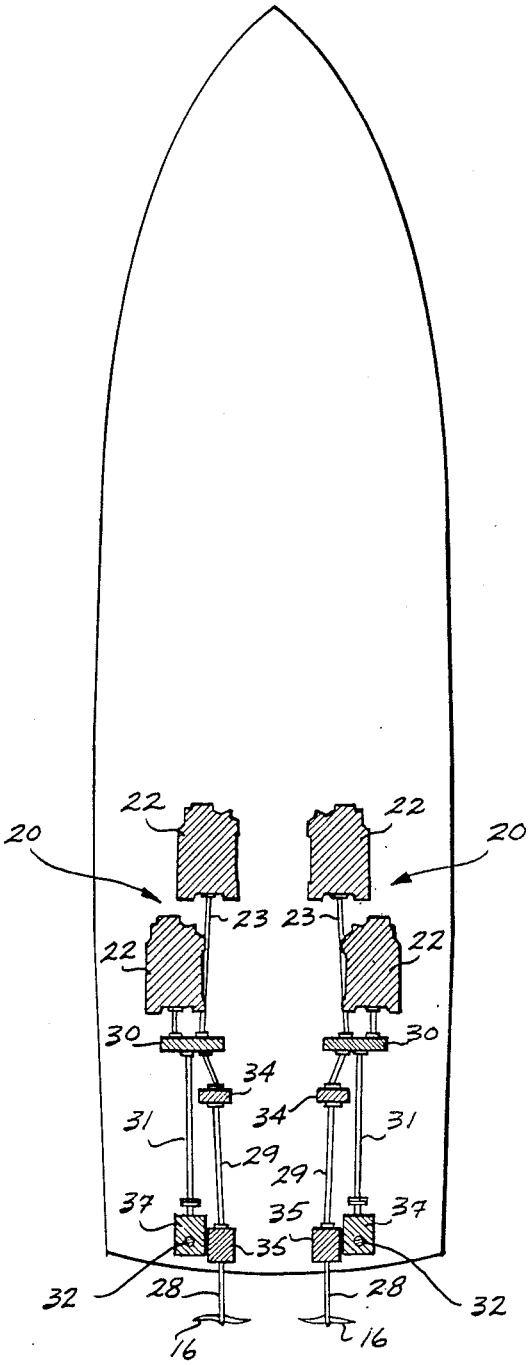
FIG. 2 is a pictorial top plan view of the hydrofoil craft depicting the installation of the propulsion system of FIG. 1.

Referring to FIGS. 1 and 2, the hydrofoil propulsion system 10 is located at the stern 12 of the hydrofoil craft 14. The propulsion system 10 utilizes dual water propellers 16 in combination with dual air propellers 18. Preferably, the air propellers are shrouded to direct the thrust to the stern 12 of the craft. The air propellers 18 and water propellers 16 are powered by a common power source 20, preferably four diesel engines 22 mounted in pairs inside the hull 24 of the craft 14. Ideally, the engines 22 are Detroit Diesel 12V92TA engines with 145 injectors each delivering a maximum of 1,080 HP at 2,300 RPM. At cruising speed, outputs will be approximately 600 HP. These engines are manufactured by Detroit Diesel located in Detroit, Mich. The output of the two engines 22 is coupled through output shafts 23 to a common mixing gearbox 30 having clutches for each engines 22. With this arrangement, each engine 22 in a pair may be separately engaged or disengaged with the mixing gearbox 30. This permits continued operation of the hydrofoil should one of the engines malfunction.

In the preferred embodiment, the air propellers 18 are variable pitch having a low tip speed to reduce noise levels. Each air propeller 18 is directly geared to its respective mixing gearbox 30 through a gear train that includes a lower horizontal shaft 31 coupled to a lower 90° gearbox 37, a vertical shaft 32 engaged with the lower gearbox 37 and an upper 90° gearbox 39, and an upper horizontal shaft 33 that couples the upper gearbox 39 to the air propeller 18. Although the preferred embodiment illustrates a single air propeller 18 mounted within each shroud 26, two counterrotating air propellers may also be mounted within each shroud 26.

Each water propeller 16 is preferably affixed to a propeller shaft 28 pivotally coupled to an outdrive 35 that permits the propeller shaft 28 and the water propeller 16 to be moved horizontally back and forth and vertically raised or lowered with respect to the hull 24. The pivotal movement of the propeller shafts 28 gives greater maneuverability to the craft 14 when it is operating in the hullborne mode and also permits rapid retraction of the water propellers 16 as the craft 14 transitions from the hullborne mode to the foilborne mode to reduce drag and decrease transition time. Each water propeller 16 is geared to a mixing gearbox 30 through a drive shaft 29 coupled to a reversible gearbox 34 having a clutch to permit selective engagement of the water propeller 16 to the pair of engines 22. The reversible gearbox 34 permits operation of the water propeller 16 in a clockwise or counterclockwise direction.

When the hydrofoil craft 14 is operating in the hullborne mode, the hydrofoils 36 are vertically raised out of the water 38 to the position shown by the dotted lines in FIG. 1. Steering in the hullborne mode is done by the pivotally mounted water propellers 16. In addition, either of the water propellers can be reversed to provide differential thrust to improve maneuverability when docking. To further aid in maneuvering at dockside, bow thrusters 40, shown in FIG. 1, may also be installed.

When the hydrofoil craft 14 accelerates for takeoff, the shrouded air propellers 18 will be less efficient than the water propellers 16 due to the low air speed. Thus, the main thrust will come from the water propellers 16. As speed increases and the hull 24 is lifted out of the water 38, the water propellers 16 will become less efficient than the air propellers 18. In the preferred embodiment, the water propellers 16 will reach maximum efficiency when the craft 14 is travelling at approximately 20 knots, and the air propellers 18 will reach maximum efficiency at approximately 40 knots. At this point, as the craft transitions from the hullborne mode to the foilborne mode, the thrust load will be transferred automatically to the air propellers 18. When the transition to the foilborne mode is completed, the water propellers 16 are declutched from the engines 22 by the clutch in the gear box 34 and are raised up into the hull 24. At this point, the high performance shrouded air propellers 18 accelerate the craft 14 to its top speed, approximately 42 knots.

One of the problems to be solved with a combination air and water propulsion system on a hydrofoil is the generation of a constant forward thrust. In order to generate a maximum constant thrust during the transition of the hydrofoil from hullborne to foilborne operation, variable-pitch air propellers 18 are provided to use any horsepower not used by the water propellers 16 and convert the horsepower into thrust. In the representative embodiment, the air propellers 18 utilize blades such as the Hamilton Standard 7111A-18 mounted on a conventional constant-speed hub 19. The advantage of this arrangement is that the propeller's pitch can automatically adjust to various amounts of horsepower to produce maximum thrust. When the hull of the hydrofoil lifts off the surface of the water, the water propellers 16 are lifted out of the water and can no longer absorb horsepower and produce thrust. The horsepower previously absorbed by the water propellers 16 can now be transmitted to the air propellers 18 by changing the pitch of the propellers 18. While this can be done manually, the preferred method is to use a commercially available constant-speed or governor-controlled hub 19.

A simplified electronic control system is used to control the water propellers 16 and the engines 22. The horizontal position of the pivotally mounted propeller shafts 28 is controlled by an electronic switch at the helm of the craft that permits variable horizontal positioning of the propeller shafts 28. In addition, an electronic switch permits selection of the forward or reverse operating modes through the gear box 34 for the water propellers 16. Finally, the speed of the engines 22 is controlled by throttles linked to governers on the engines. During take-off and cruise, the throttles are typically set to have the engines operate at maximum capacity.

As will be readily appreciated from the foregoing description, the hydrofoil propulsion system formed in accordance with the present invention takes advantage of the maximum thrust capabilities of water propellers and the efficient high-speed thrust capabilities of shrouded air propellers coupled to a common power source to efficiently propel the hydrofoil craft as it transitions from a waterborne mode to a foilborne mode. By removing the water propulsion system from the water when the hydrofoil craft is in the foilborne mode, drag is decreased resulting in higher speed capabilities. Furthermore, the additional thrust generated by the air propellers achieves an increased cruising speed at higher efficiencies in the foilborne mode. This permits greater field capacity and a longer range than has been previously achieved in hydrofoil craft.

It will be appreciated that various modifications may be made to this system without departing from the spirit and scope of the invention. For instance, jet pumps may be used instead of water propellers to develop thrust and provide maneuverability when the craft 14 is in the hullborne mode. As the hull 24 raises out of the water and the jet pumps cavitate, the shrouded air propellers 18 will provide the thrust for acceleration and cruising. Furthermore, the shrouded air propellers may have a separate drive system than that of the water propellers, i.e., a high horsepower engine coupled to the water propellers for the take-off and a low horsepower engine coupled to the air propellers for cruising. Consequently, the invention can be practiced otherwise than as specifically described herein.

The embodiments of the invention in which an exclusive property or privilege is claimed are defined as follows:

1. A propulsion system for a hydrofoil watercraft capable of operating in either a waterborne mode or a foilborne mode, the propulsion system comprising:

at least one variable-pitch air propeller assembly positioned to propel the hydrofoil watercraft horizontally across the water;

at least one water propeller positioned to propel the hydrofoil watercraft horizontally across the water; and at least one motor means operably coupled to said at least one air propeller and said at least one water propeller to drive said at least one air propeller and said at least one water propeller, said air propeller assembly including means for automatically changing the pitch of the blades of the air propeller assembly to absorb horsepower from said motor means as said watercraft becomes foilborne and said water propeller lifts out of the water.

2. The propulsion system of claim 1, wherein said at least one air propeller is shrouded.

3. The propulsion system of claim 2, wherein said at least one water propeller is pivotally mounted to said hydrofoil watercraft for vertical movement.

4. The propulsion system of claim 2, wherein said at least one motor means is operably coupled to said at least one air propeller and said at least one water propeller by a clutch means to permit said at least one motor means to be selectively engaged and disengaged from said at least one air propeller and said at least one water propeller.

5. A propulsion system for a hydrofoil watercraft capable of operating in either a waterborne mode or a foilborne mode, the propulsion system comprising:

a first variable-pitch air propeller assembly and a second variable-pitch air propeller assembly positioned to propel the hydrofoil watercraft across the water;

a first water propeller and a second water propeller positioned to propel the hydrofoil watercraft horizontally across the water;

a first drive motor operably coupled to said first air propeller and said first water propeller for driving said first air propeller and said first water propeller; and, a second drive motor operably coupled to said second air propeller and said second water propeller for driving said second air propeller and said second water propeller, each of said air propeller assemblies including means for automatically changing the pitch of the blades of the air propeller assembly to absorb horsepower from the respective drive motors as said watercraft becomes foilborne and said water propellers lift out of the water.

6. The propulsion system of claim 5, wherein said first drive motor is operably coupled to said first air propeller and said water propeller for selective engagement by a clutch means, and said second drive motor is operably coupled to said second air propeller and said second water propeller for selective engagement by a second clutch means.

7. The propulsion system of claim 6, wherein said first water propeller and said second water propeller are pivotally mounted to said hydrofoil watercraft for vertical movement.

8. The propulsion system of claim 6, wherein said first air propeller and said second air propeller are shrouded.

9. In a method for operating a hydrofoil watercraft in the transition from a waterborne mode to a foilborne mode, said watercraft having a motor means operably coupled to drive both a water propeller and an air propeller, said water propeller lifting from the water as said watercraft becomes foilborne, the improvement comprising automatically changing the pitch of the blades of the air propeller to absorb horsepower from the motor means as said watercraft becomes foilborne and the water propeller lifts from the water.

* * * * *